US008776953B2

(12) United States Patent
Han et al.

(10) Patent No.: US 8,776,953 B2
(45) Date of Patent: Jul. 15, 2014

(54) MAGNETIC ELEVATOR DOOR COUPLER

(75) Inventors: HakKi Han, Yangcheng-gu (KR); Zbigniew Piech, Cheshire, CT (US); David J. Lanesey, Harwinton, CT (US); Pawel Witczak, Lodz (PL)

(73) Assignee: Otis Elevator Company, Farmington, CT (US)

( * ) Notice: Subject to any disclaimer, the term of this patent is extended or adjusted under 35 U.S.C. 154(b) by 886 days.

(21) Appl. No.: 12/810,524

(22) PCT Filed: Dec. 19, 2008

(86) PCT No.: PCT/US2008/087677
§ 371 (c)(1),
(2), (4) Date: Jun. 25, 2010

(87) PCT Pub. No.: WO2009/086104
PCT Pub. Date: Jul. 9, 2009

(65) Prior Publication Data

US 2010/0282546 A1 Nov. 11, 2010

(30) Foreign Application Priority Data

Dec. 28, 2007 (KR) ..... 10-2007-0140614
Dec. 28, 2007 (KR) ..... 10-2007-0140616

(51) Int. Cl.
*B66B 13/02* (2006.01)
*B66B 13/12* (2006.01)

(52) U.S. Cl.
USPC ..... 187/319

(58) Field of Classification Search
CPC ..... B66B 13/02; H01F 7/06; H01F 7/13
USPC ..... 187/319, 330; 49/116, 120, 370; 307/104
See application file for complete search history.

(56) References Cited

U.S. PATENT DOCUMENTS 3,407,482 A * 10/1968 Rushing ..... 29/596
5,487,449 A * 1/1996 Barrett et al. ..... 187/330
6,070,700 A * 6/2000 Nagel ..... 187/335

(Continued)

FOREIGN PATENT DOCUMENTS

DE 10141985 A1 4/2003
WO 2006009536 A2 1/2006

(Continued)

OTHER PUBLICATIONS

International Search Report and Written Opinion of the International Searching Authority for International application No. PCT/US2008/087677 mailed Mar. 30, 2009.

(Continued)

*Primary Examiner* — William E Dondero
*Assistant Examiner* — Diem Tran
(74) *Attorney, Agent, or Firm* — Carlson, Gaskey & Olds

(57) ABSTRACT

An elevator door coupler includes a vane member adapted to be supported on one of a hoistway door or an elevator car door. A magnetic coupler device (500) is adapted to be supported on the other of the hoistway door or the elevator car door to be selectively magnetically coupled with the vane member. The magnetic coupler device includes a plurality of modules (520) each having a core and at least one coil associated with the core. An insulation material (528) occupies a space between the modules for substantially insulating adjacent coils from each other and for maintaining a desired alignment of the modules relative to each other.

20 Claims, 9 Drawing Sheets

(56) References Cited

U.S. PATENT DOCUMENTS

2010/0038187 A1* 2/2010 Gieras et al. ..... 187/330
2012/0205505 A1* 8/2012 Piech et al. ..... 248/206.5

FOREIGN PATENT DOCUMENTS

WO WO 2006009536 A2 * 1/2006
WO WO 2007044008 A1 * 4/2007
WO WO 2008118165 A1 * 10/2008 ..... B66B 13/12

OTHER PUBLICATIONS

International Preliminary Report on Patentability for International application No. PCT/US2008/087877 mailed Jul. 8, 2010.

* cited by examiner

MAGNETIC ELEVATOR DOOR COUPLER

CROSS-REFERENCE TO RELATED APPLICATIONS

This application claims priority to and hereby incorporates by reference in their entirety Korea Patent Application No. 10-2007-0140614 and Korea Patent Application No. 10-2007-0140616, both of which were filed on Dec. 28, 2007.

BACKGROUND

Elevators typically include a car that moves vertically through a hoistway between different levels of a building. At each level or landing, a set of hoistway doors are arranged to close off the hoistway when the elevator car is not at that landing. The hoistway doors open with doors on the car to allow access to or from the elevator car when it is at the landing. It is necessary to have the hoistway doors coupled appropriately with the car doors to open or close them.

Conventional arrangements include a door interlock that typically integrates several functions into a single device. The interlock locks the hoistway doors, senses that the hoistway doors are locked and couples the hoistway doors to the car doors for opening purposes. While such integration of multiple functions provides lower material costs, there are significant design challenges presented by conventional arrangements. For example, the locking and sensing functions must be precise to satisfy codes. The coupling function, on the other hand, requires a significant amount of tolerance to accommodate variations in the position of the car doors relative to the hoistway doors. While these functions are typically integrated into a single device, their design implications are usually competing with each other.

Conventional door couplers include a vane on the car door and a pair of rollers on a hoistway door. The vane must be received between the rollers so that the hoistway door moves with the car door in two opposing directions (i.e., opening and closing). Common problems associated with such conventional arrangements are that the alignment between the car door vane and the hoistway door rollers must be precisely controlled. This introduces labor and expense during the installation process. Further, any future misalignment results in maintenance requests or call backs.

Additionally, with conventional arrangements debris build up on the door track and static pressure from the stack effect tend to impede the hoistway doors from fully closing. Moreover, with conventional designs, separately driving the hoistway doors closed causes delays in the door opening and closing times, which can appear to be an inconvenience to passengers.

It is desirable to have hoistway doors driven completely closed by the car doors (to avoid call back and maintenance problems) while at the same time addressing the aforementioned issues. There have been proposals to use electromagnetic elevator door coupler components. One such example is shown in the published application WO 2006/009536. Even with such advances, those skilled in the art are always striving to make improvements.

SUMMARY OF THE INVENTION

An exemplary elevator door coupler includes a vane member that is adapted to be supported on one of a hoistway door or an elevator car door. A magnetic coupler device is adapted to be supported on the other of the hoistway door or the elevator car door to be selectively magnetically coupled with the vane member. The magnetic coupler device includes a plurality of modules each having a core and at least one coil associated with the core. An insulation material occupies a space between the modules for substantially insulating adjacent coils from each other and for maintaining a desired alignment of the modules relative to each other.

An exemplary elevator door assembly includes at least one hoistway door and at least one elevator car door. A vane member is supported for movement with the hoistway door. A magnetic coupler device is supported for movement with the elevator car door to be selectively magnetically coupled with the vane member. The magnetic coupler device includes a plurality of modules each having a core and at least one coil associated with the core. An insulation material occupies a space between the modules for substantially insulating adjacent coils from each other and for maintaining a desired alignment of the modules relative to each other.

The various features and advantages of the disclosed examples will become apparent to those skilled in the art from the following detailed description of the currently preferred embodiments. The drawings that accompany the detailed description can be briefly described as follows.

DETAILED DESCRIPTION

Figure 1:
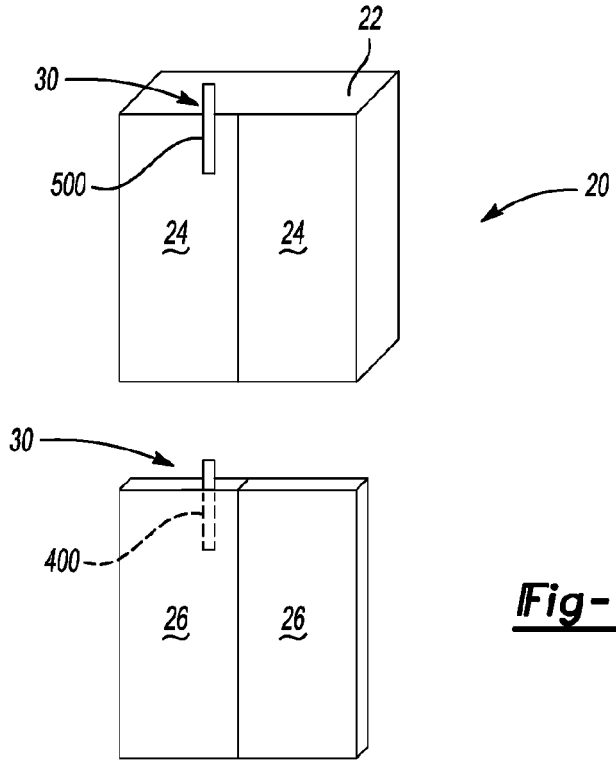
FIG. 1 schematically illustrates selected portions of an elevator system incorporating a door assembly designed according to an embodiment of this invention.

FIG. 1 schematically illustrates selected portions of an elevator system 20 including an elevator car 22 that is situated for movement within a hoistway in a known manner. The elevator car 22 includes elevator car doors 24 that are selectively moveable between open and closed positions to provide access to the interior of the elevator car 22. Hoistway doors 26 are provided at a plurality of landings along the hoistway in a known manner. An elevator door coupler 30, which includes a magnetic coupler device 500, facilitates moving the hoistway doors 26 with the elevator car doors 24. The illustrated example includes a metallic vane member 400 supported for movement with the hoistway doors 26. The magnetic coupler device 500 is supported for movement with the elevator car doors 24. A magnetic coupling between the magnetic coupler device 500 and the vane member 400 is operative to maintain the desired coordinated movement of the hoistway doors 26 with the elevator car doors 24 (e.g., between open and closed positions).

Figure 2:
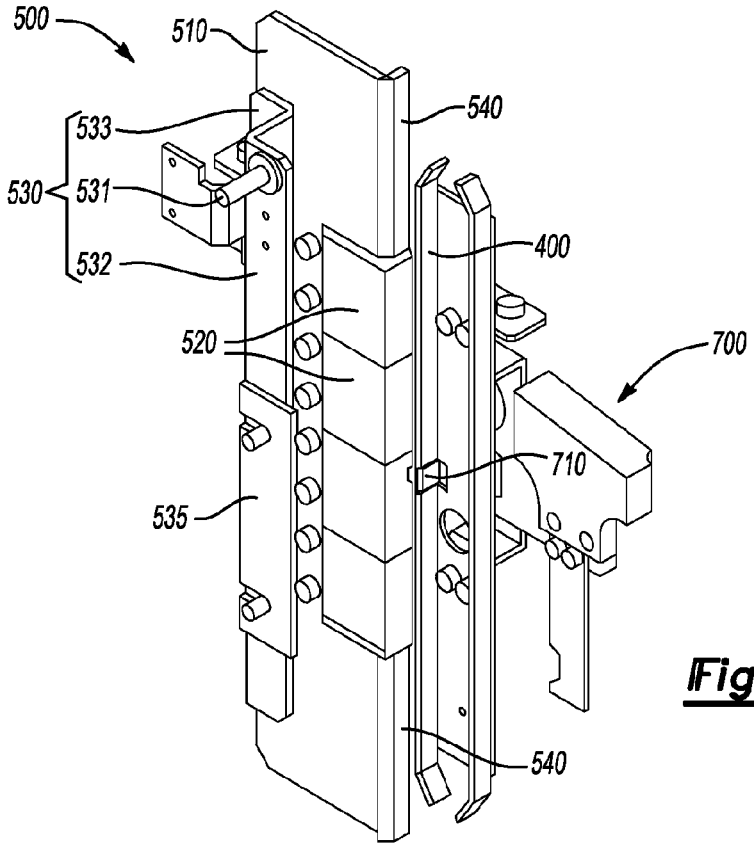
FIG. 2 is a perspective, diagrammatic illustration of an example elevator door coupler.

FIG. 2 illustrates one example magnetic coupler device 500 and an example vane member 400. In this example, a vane body 510 supports a plurality of modules 520 that provide an electromagnetic force for coupling the magnetic coupler device 500 with the vane member 400.

Figure 3:
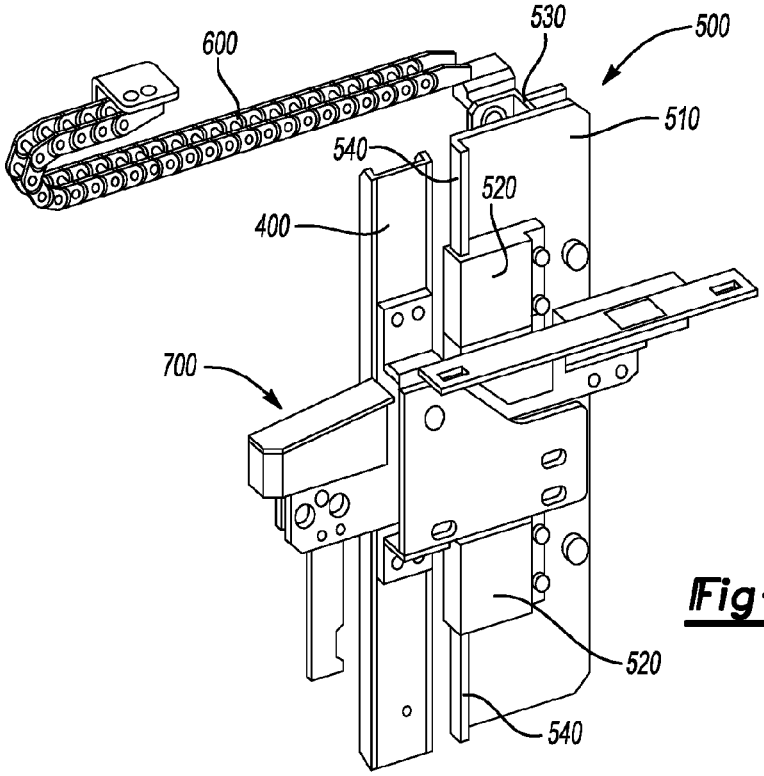
FIG. 3 is a perspective, diagrammatic illustration of the example of FIG. 2 shown from another perspective with selected additional components.
Figure 4:
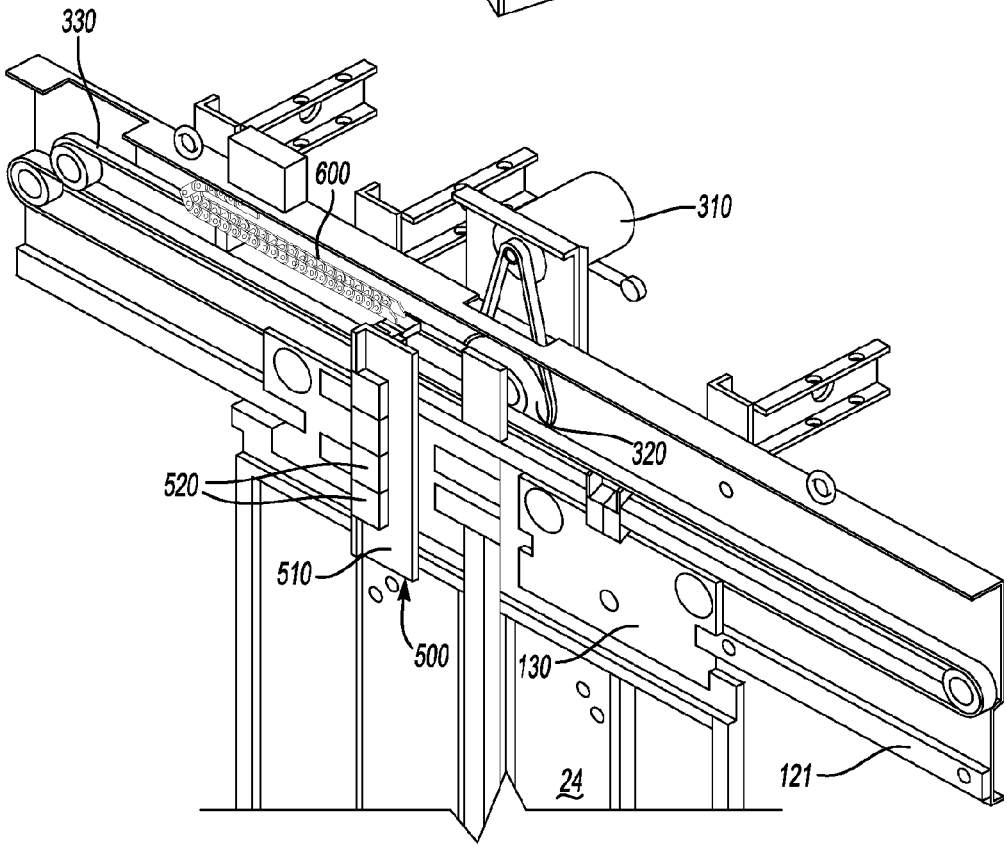
FIG. 4 is a perspective, diagrammatic illustration of a magnetic coupler device associated with elevator car doors and associated structure.

As can be appreciated from FIGS. 2-4, a mounting support 530 includes a connecting member 531 that is configured to be connected with a moving portion of a door mover 310 so that the magnetic coupler device 500 moves with an elevator car door 24, for example. The illustrated arrangement includes a hanger connecting part 532 and a vane connecting part 533, which are each a surface on a mounting bracket in this example. One or more plate-like shims 535 facilitate achieving a desired alignment between the hanger connecting part 532 and an associated door hanger 130.

As shown in FIG. 3, a protective cable-carrying chain 600 is arranged to contain cables used for providing power, control signals or both to the magnetic coupler device 500. The chain 600 protects the cables and allows for adequate movement of the components as needed to achieve desired elevator door movement.

FIG. 4 illustrates the example magnetic coupler device 500 secured to a door hanger 130 of the elevator car doors 24. In this example, the door hanger 130 moves along a track 121 in a known manner. The illustrated door mover 310 includes a motor that provides a driving force for opening and closing the elevator car doors 24. When the vane member 400 is magnetically coupled with the magnetic coupler device 500, the associated hoistway doors 26 move with the elevator car doors 24. The motor of the door mover 310 causes movement of a moving member 330 to cause the desired movement of the elevator car doors 24. In this example, the moving member 330 comprises a belt. The motor causes rotation of a pulley 320, which causes corresponding movement of the belt 330.

In this example, the connecting part 531 (FIG. 2) is fixedly connected to the belt 330 and the door hanger connector part 532 is fixedly connected to the door hanger 130 so that the magnetic coupling device 500 is securely mounted in a stable position for movement with the elevator car doors 24. The vane connecting part 533, the hanger connecting part 532 and the shims 535 are configured to position the magnetic coupler device 500 relative to the door hanger 130 with spacing between them while still providing a stable connection. In one example, a plurality of the shims 535 are layered to a desired thickness and bolts or other fasteners are used for securing the magnetic coupler device 500 in position.

One feature of the illustrated example is that the magnetic coupler device 500 generates an electromagnetic force to achieve the desired coupling. As known, electromagnets generate heat. The illustrated arrangement facilitates distributing such heat through the mounting support 530, the vane body 510 and the car door hanger 130. The heat generated by the electromagnet is therefore disbursed across a wider surface area and more readily dissipated and released into the air. Such an arrangement facilitates maintaining a desired operation and performance of the magnetic coupler device 500 over time and reduces concern regarding heat damage to the electromagnet.

Figure 5:
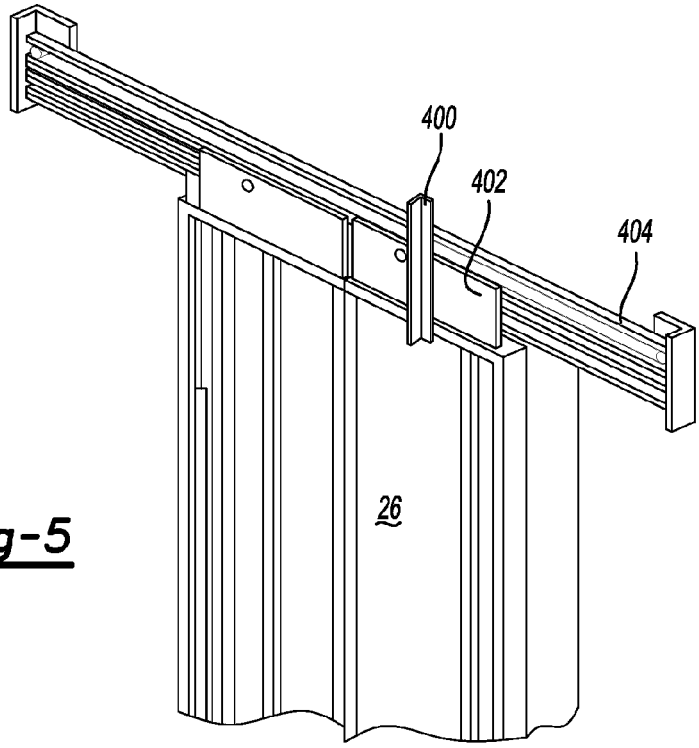
FIG. 5 diagrammatically illustrates a vane member associated with hoistway doors.

FIG. 5 shows the example vane member 400 secured to a door hanger 402 associated with the hoistway doors 26. The door hanger 402 facilitates movement of the hoistway doors 26 along a track 404 in a known manner. When the vane member 400 is appropriately magnetically coupled with the magnetic coupler device 500, the hoistway doors 26 move with movement of elevator car doors 24.

Figure 6:
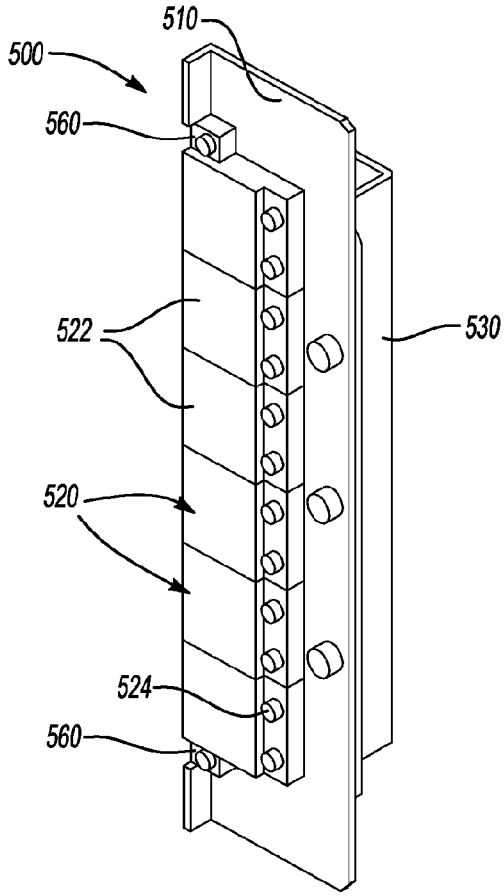
FIG. 6 illustrates selected portions of an example magnetic coupler device.
Figure 7:
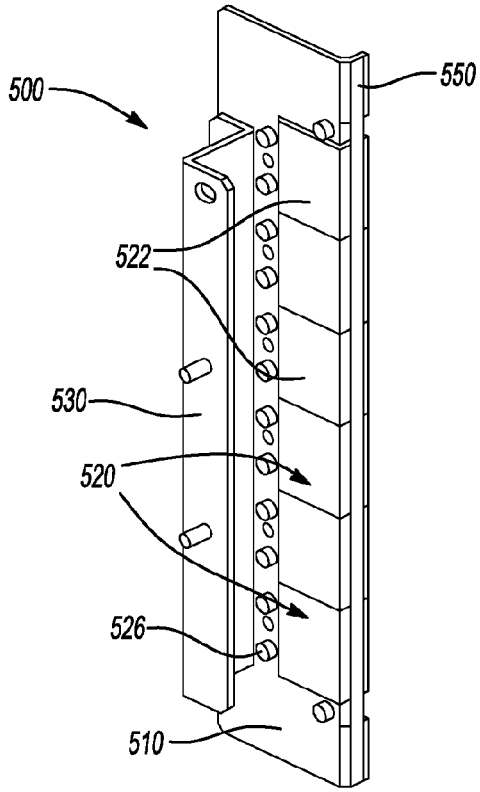
FIG. 7 illustrates the example of FIG. 6 from another perspective.
Figure 8:
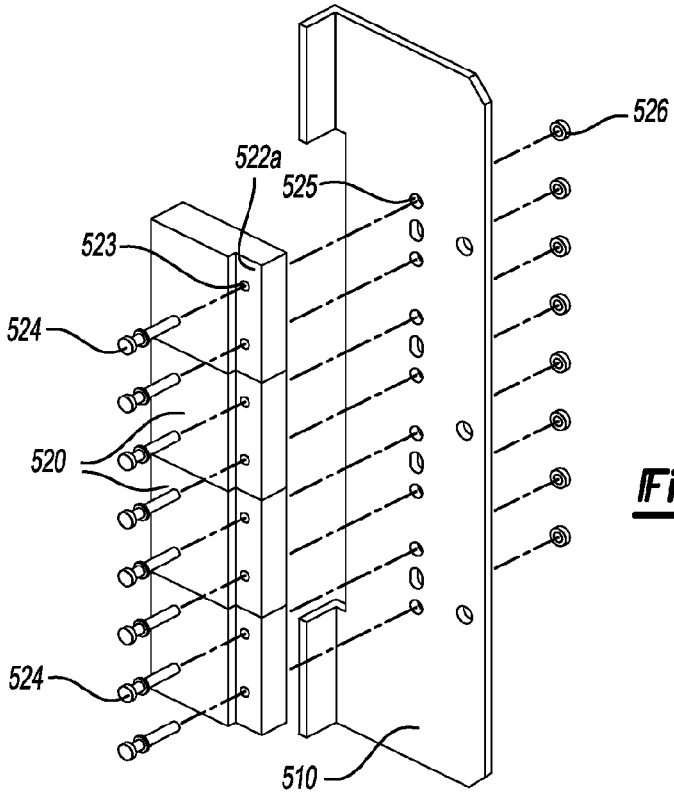
FIG. 8 is a partially exploded view illustrating an assembly of the example of FIGS. 6 and 7.
Figure 9:
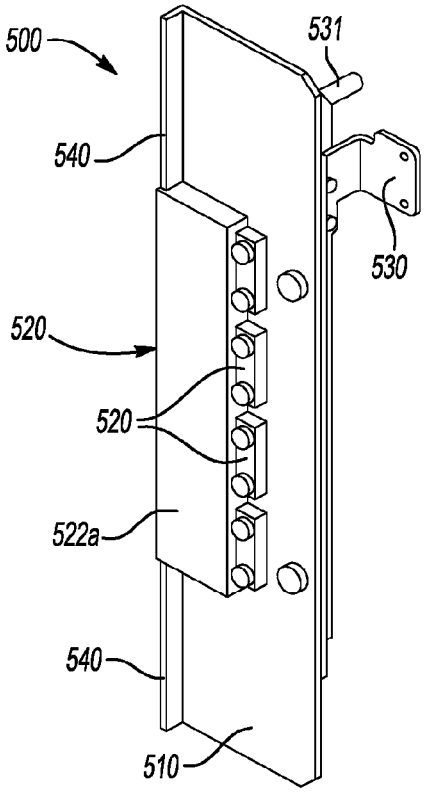
FIG. 9 illustrates another example arrangement of selected portions of a magnetic coupler device.
Figure 10:
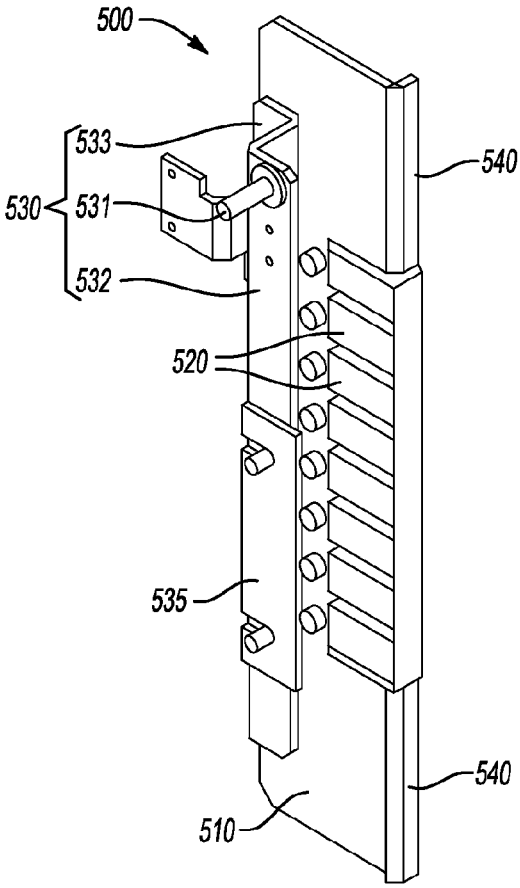
FIG. 10 illustrates the example of FIG. 9 from another perspective.
Figure 11:
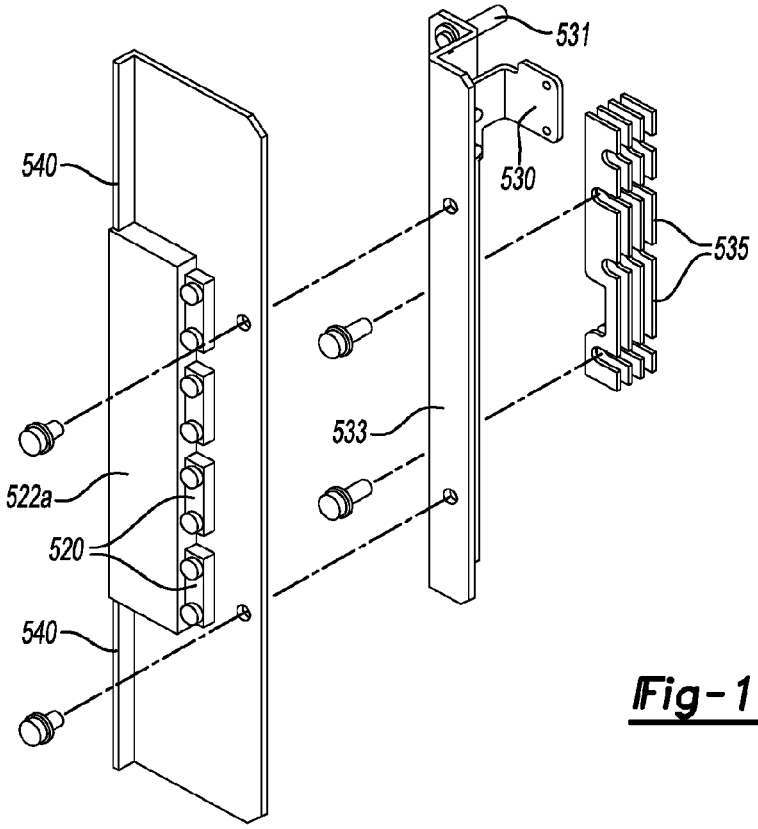
FIG. 11 is a partially exploded view illustrating an example assembly of the example of FIGS. 9 and 10.
Figure 15:
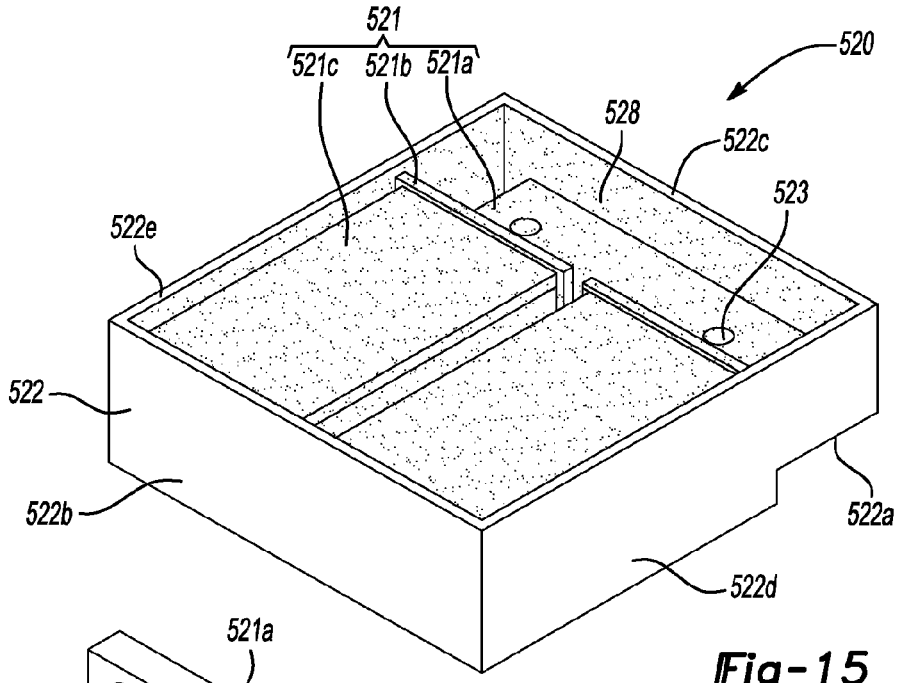
FIG. 15 illustrates an example housing and module used with the example of FIG. 6.

FIGS. 6-8 and 15 illustrate one example configuration of a magnetic coupler device 500. In this example, the electromagnet comprises a plurality of modules 520 that are each housed within an individual housing 522. FIG. 15 illustrates one such example housing and module. In this example, each module 520 includes the housing 522 and an electromagnet 521. A mounting portion 521*a* is formed as part of a core 521*b* of each electromagnet 521. Conductive coils 521*c* are wound about coil-supporting portions (legs) of the core 521*b*. The mounting portion 521*a* includes mounting holes 523 that are aligned with corresponding holes in one sidewall 522*a* of the housing 522. In the example of FIGS. 6-8, a plurality of threaded bolts 524 are received through the openings 523 and openings 525 in the vane body 510. Threaded securing members such as nuts 526 are received on opposite ends of the bolts 524 for holding the modules 520 in a desired position against the vane body 510.

In this example, a fixing tape 550 is received across one side of the vane body 510 and ends of the modules 520 to maintain a desired linear alignment of the ends of the modules 520. Adjacent sidewalls of the housings 522 are received against each other and positioning blocks 560 are provided at the outside ends of the row of housings 522 for maintaining the desired alignment of the modules 520 relative to each other on the vane body 510.

As can be appreciated from FIG. 15, the housing 522 includes a plurality of sidewalls 522*a*-522*e*. In this example, one side of the housing 522 is left open to facilitate inserting the electromagnet 521 into the housing 522. An insulation material 528 is introduced into the housing to occupy, and ideally fill, any spacing between the electromagnet 521 and the interior of the housing 522. In one example, the insulation material 528 comprises a urethane that is introduced into the housing in a fluid state. The insulation material 528 is then allowed to subsequently solidify so that it maintains a desired position of the electromagnet 521 within the housing 522.

In the example of FIG. 15, the opening along one side of the housing 522 (e.g., the side facing upward according to the drawing) would have left the electromagnet 521 exposed along that side. In this example, the insulation material 528 substantially covers any surfaces of the electromagnet 521 facing the opening in the housing 522. In this example, therefore, all sides and substantially all surfaces of the electromagnet 521 are covered by an electrically insulating material. Encasing the electromagnet 521 in this way protects it from debris, for example, when used in an elevator hoistway.

In one example, the housing 522 is injection-molded from an electrically insulating material such as polyamide. Having the electromagnets 521 encased in the housing 522 in the insulating material 528 prevents a decrease in performance and any hindrance of precise operation that would otherwise arise due to peripheral iron, powder and/or dust collecting on the electromagnetic modules 520. If such dust and/or debris were allowed to collect, precise control of the electromagnetic force would be hindered because of the magnetization of such collected debris.

In one example, the sidewalls 522*a*-522*e* of the housing 522 have a thickness of 0.5 mm. Such sidewalls insulate the cores of the electromagnetic modules from the outside and minimize attenuation of electromagnetic force.

FIGS. 9-11 and 17 illustrate another example that includes a single housing 522 at least partially containing a plurality of modules 520. As can be appreciated in FIGS. 9 and 11, one side of the housing 522 is a continuous sidewall 522*a*. An oppositely facing side (also shown in FIG. 17) includes an opening that facilitates inserting the electromagnets 521 in position. Insulation material 528 is introduced into the housing to occupy, and ideally fill, all spaces between adjacent electromagnets 521 and all spaces between the electromagnets 521 and the interior of the housing 522. The insulation material 528 in this example also substantially covers any surfaces of the electromagnets 521 aligned with and facing the opening on the one side of the housing 522.

In the example of FIGS. 9-11 and 17, the mounting portions 521*a* of the electromagnets 521 are not received within the housing 522. Instead, the mounting portions 521*a* remain exposed outside of the housing 522 as can best be appreciated from FIG. 17. In this example, therefore, all surfaces of the electromagnets 521 that are within the housing 522 are coated with the insulation material 528. The mounting portions 521*a* remain exposed and are not necessarily covered with the same insulation material 528. In some examples, the mounting portions 521*a* are coated with an electrically insulating coating before or after the electromagnets are positioned in the housing 522.

One difference of the example of FIGS. 9-11 and 17 compared to the example of FIGS. 6-8 and 15 is that no fixing tape is provided for maintaining a desired alignment of the ends of the electromagnets 521. In this example, a single, continuous sidewall 522*a* of the housing 522 provides that desired alignment to ensure a desired operation of the magnetic coupler device 500 and proper cooperation with the vane member 400.

Figure 12:
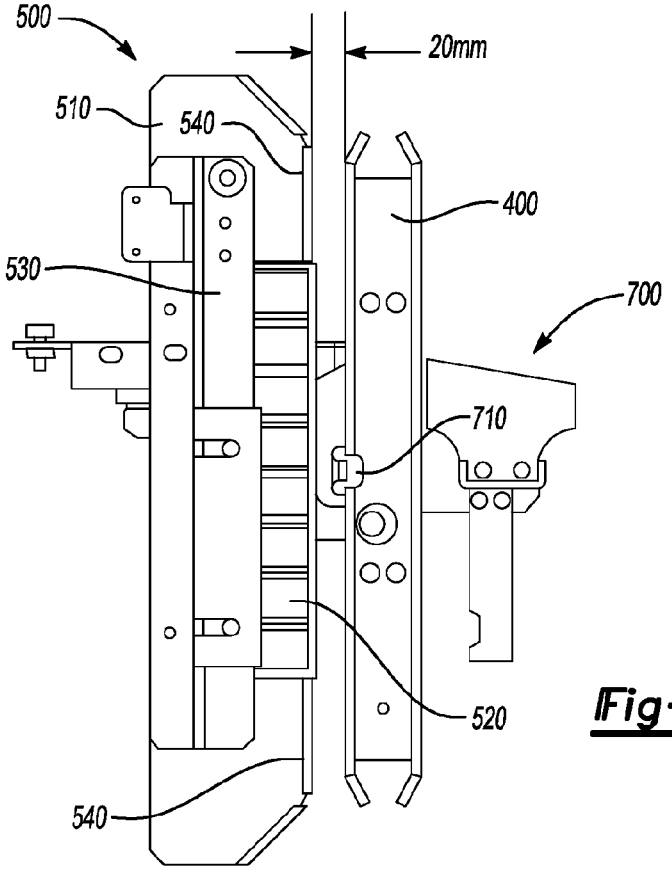
FIG. 12 illustrates a locking feature associated with an example elevator door coupler.
Figure 13:
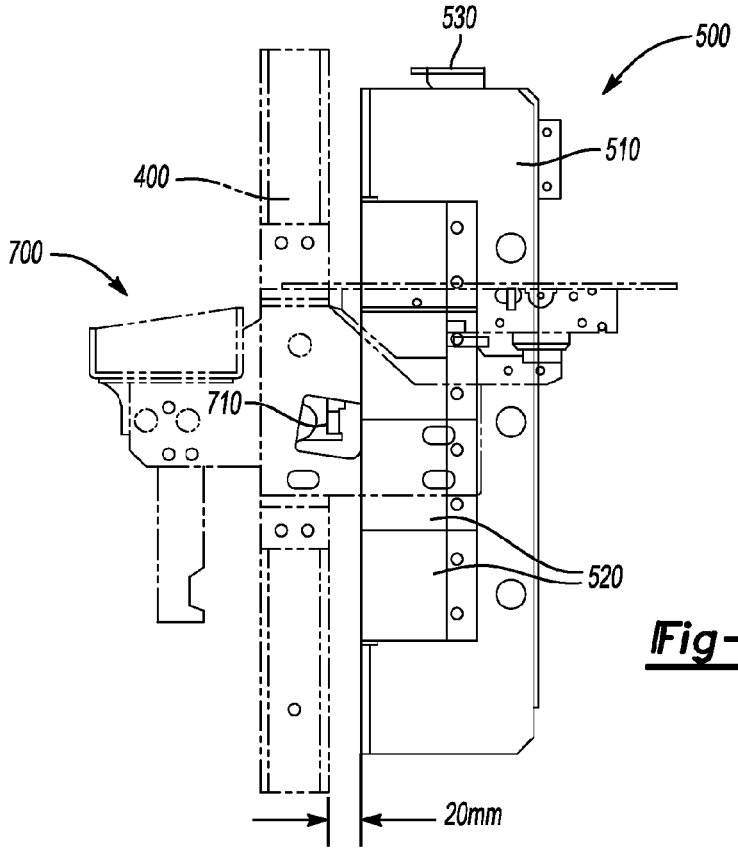
FIG. 13 illustrates the components shown in FIG. 12 from another perspective.
Figure 14:
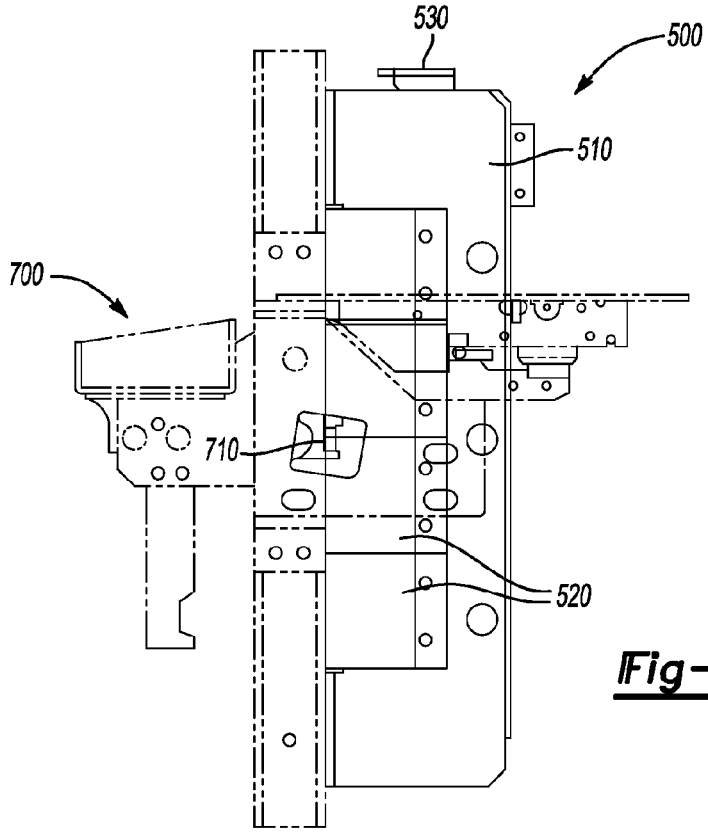
FIG. 14 shows the example of FIG. 13 in another operative state.

Referring to FIGS. 12-14, the vane member 400 is associated with a hoistway door lock 700. This example includes a lock release member 710 positioned to be contacted by a surface of the magnetic coupler device 500 for purposes of unlocking the hoistway doors 26 to allow desired movement of them with the elevator car doors 24. As indicated in FIG. 12, a default separation gap of about 20 mm exists between the magnetic coupler device 500 and the vane member 400 based upon the installation of those components within the elevator system 20. The lock release member 710 is configured to unlock the hoistway doors 26 when appropriate pressure is applied as the magnetic coupler device moves within approximately 5 mm of the vane member 400. In this example, a forward facing end of a module 520 presses against the lock release member 710, moving it from the position illustrated in FIG. 13 to the position illustrated in FIG. 14. At this point, the hoistway doors 26 are unlocked and can be moveable into an open position with the elevator car doors 24.

In one example, the magnetic coupler device 500 continues moving closer to the vane member 400 until there is contact between the two components. Some examples include a resilient layer 540 on a forward facing surface of at least a portion of the vane body 510 to provide a cushioning effect when there is contact between the magnetic coupler device 500 and the vane member 400. When an appropriate amount of electrical current is provided to the electromagnets 521, a sufficient electromagnetic force is generated for magnetically coupling the vane member 400 to the magnetic coupler device 500.

Figure 16:
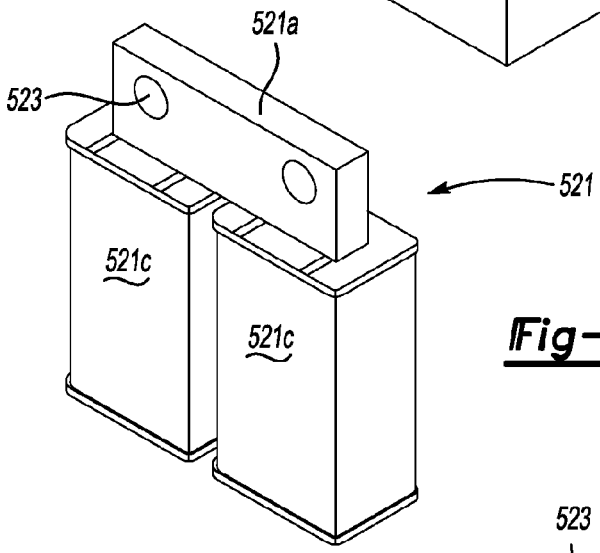
FIG. 16 diagrammatically illustrates an example module.
Figure 17:
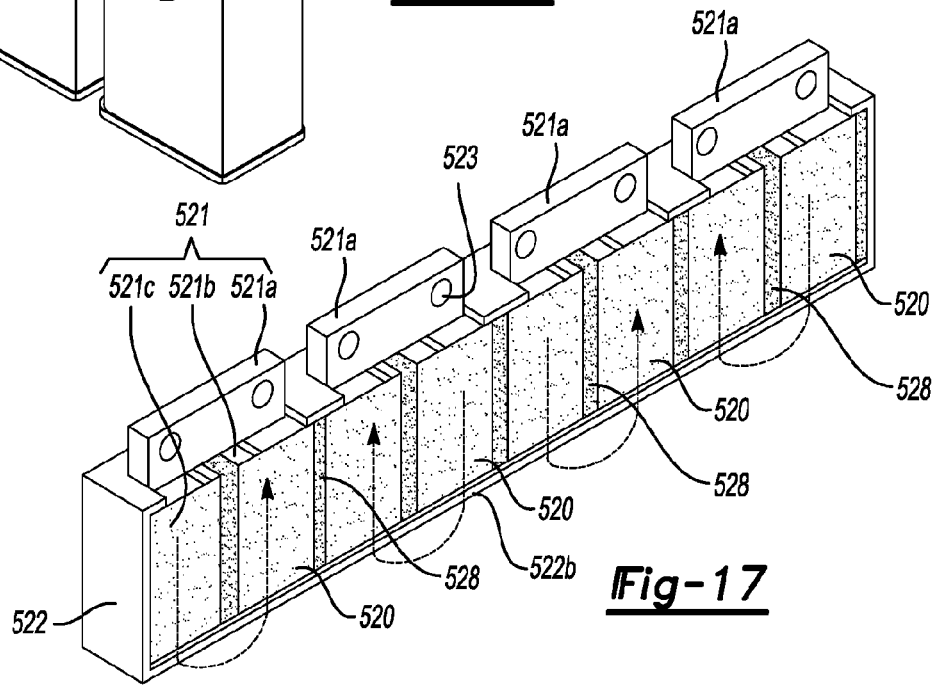
FIG. 17 illustrates an example housing and a plurality of modules used with the example of FIG. 9.
Figure 18:
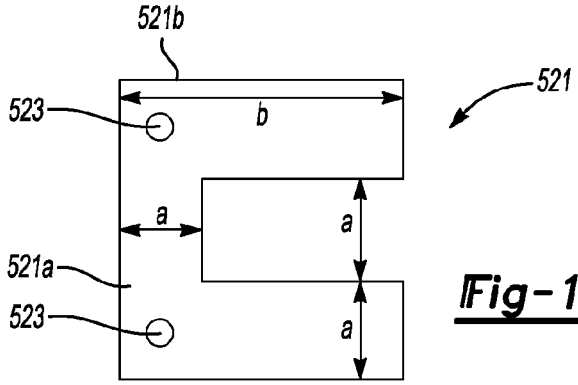
FIG. 18 schematically illustrates an example portion of one example magnet configuration.

As shown in FIGS. 16 and 18, each of the electromagnets 521 includes a generally U-shaped core 521*b* that includes two legs that are connected by the mounting portion 521*a*. Conductive windings 521*c* and an associated bobbin are supported on the legs of the core 521*b* as schematically shown in FIG. 16 in a generally known manner.

As best appreciated from FIG. 18, the legs of the U-shaped core 521*b* have a length b that corresponds to three times the width a of the connecting mounting portion 521*a* taken in the same direction. A width of each leg of the core 521*b* and a spacing between the legs of the core 521*b* each corresponds to the same dimension a in this example.

The dimensional relationships of the example core 521*b* facilitate easier preparation and assembly and a stable electromagnetic force generation. For example, comparing the example arrangement to one in which the length of the leg portions is four times the width of the connecting mounting portion taken in the same direction (as described above), a stronger magnetic flux density and electromagnetic force corresponding to 1.84 T:1.82 T and 67 N:62.7 N can be realized in a state of 1 mm separation between the modules 520 and the vane member 400 with a connecting area of 160 $mm^2$, under conditions of the same cross-sectional size of 104 $mm^2$, the same current intensity, and the same number of winding turns per unit length. Additionally, the cores 521*b* can be prepared using a material with a volume difference corresponding to 104 $mm^2 \times a$. Compared with examples where the length ratio is smaller, winding the coils in the illustrated example and the electromagnetic force generation is more precisely controllable.

Figure 19:
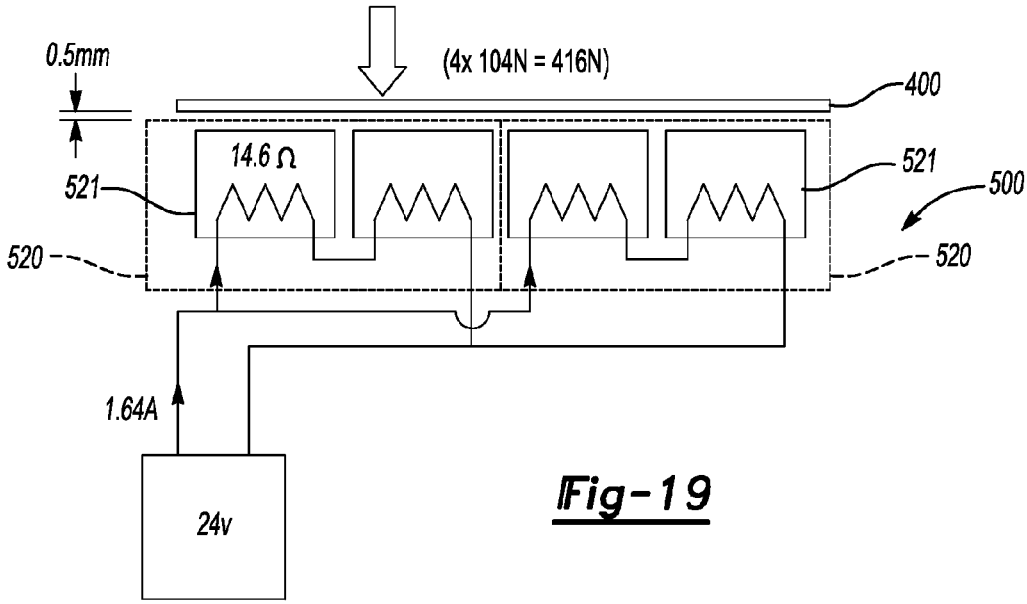
FIG. 19 schematically illustrates an example electromagnet core plate configuration.
Figure 20:
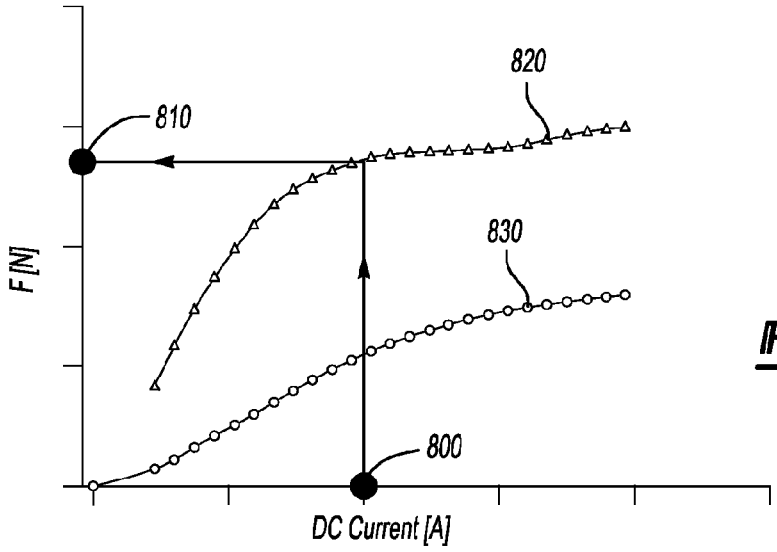
FIG. 20 graphically illustrates example relationships between electromagnetic force and current.

Referring to FIGS. 19 and 20, utilizing a plurality of electromagnets 521 allows for selectively controlling the electromagnetic force associated with coupling the magnetic coupler device 500 with the vane member 400. Individual electromagnets 521 in this example are connected electrically in series. In FIG. 19, four electromagnets 521, which define two modules 520, are illustrated each having a resistance of 14.6 Ohms and a DC power supply of 24 volts. In this example, two groups of modules 520 each include two electromagnets 521 connected in series with the groups of modules 520 connected in parallel. In this example, a current of 0.82 Amps is applied to each of the electromagnets 521. As shown in FIG. 20, the intensity of the electromagnetic force with respect to the intensity of the current supplied to the electromagnets 521 varies in a manner that allows for selecting optimum current levels. For example, a current level shown at 800 corresponds to a force level shown at 810 on a curve 820. Higher current levels do not result in significantly higher force levels and, therefore, it is possible to select the current level 800 as a highest applied current level for energizing the electromagnets 521. The example current level at 800 is considered most efficient in some examples.

In FIG. 20, the curve 820 corresponds to experimental values of an arrangement that does not include a housing 522 containing the electromagnets 521. The values shown in FIG. 20 on the curve 820 correspond to a 0.5 mm separation (shown in FIG. 19) between a vane member and electromagnets. The curve 830 corresponds to experimental values when a housing 522 is included and the housing sidewalls have a thickness of 0.5 mm. At the current supply level 800, a force level corresponding to approximately 40 N will be experienced by a vane member 400 from each electromagnet 521 when there is a separation of 0.5 mm between the vane member 400 and the electromagnets. If four electromagnets 521 are provided in such an example, the force for coupling the vane 400 to the magnetic coupler device 500 totals 160 N. Such a force is adequate for satisfying the requirement to maintain a desired coupling between the elevator car doors and the hoistway doors for achieving desired movement of them.

Using an electromagnetic coupling between the magnetic coupler device 500 and the vane member 400 facilitates easier installation as the typical tight tolerances associated with mechanical door couplers are not required. An electromagnetic coupling reduces the number of moving parts required for the door coupler arrangement. Additionally, noise can be controlled by selectively controlling the current during the coupling and uncoupling of the components at the beginning and ending of door movement, for example. Selectively controlling the current allows for gradually increasing and decreasing the electromagnetic forces at such times to reduce noises.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator door coupler, comprising:

a vane member adapted to be supported on one of a hoistway door or an elevator car door;

a magnetic coupler device adapted to be supported on the other of the hoistway door or the elevator car door to be selectively magnetically coupled with the vane member, the magnetic coupler device including a plurality of modules each having a core and at least one coil associated with the core and an insulation material occupying a space between the modules for substantially insulating adjacent coils from each other and for maintaining a desired alignment of the modules relative to each other; and at least one housing within which the plurality of modules are at least partially received.

2. The elevator door coupler of claim 1, wherein the insulation material comprises a urethane.

3. The elevator door coupler of claim 1, wherein the insulation material substantially covers the coils.

4. The elevator door coupler of claim 1, comprising a housing within which the plurality of modules are at least partially received, the insulation material occupying space within the housing between the modules and fixing the modules in the desired alignment within the housing.

5. The elevator door coupler of claim 4, wherein the housing comprises an electrically insulating material.

6. The elevator door coupler of claim 1, wherein each module is electromagnetic, the core has two legs and the coil is at least partially wound about each leg.

7. The elevator door coupler of claim 1, wherein the core of each module includes spaced apart leg portions extending from a mounting portion, the leg portions having terminal ends distal from the mounting portion; and the coil is received about the leg portions.

8. The elevator door coupler of claim 7, wherein the housing includes a sidewall against which the terminal ends of the leg portions are received, the sidewall establishing an alignment of the terminal ends.

9. The elevator door coupler of claim 8, wherein the housing includes at least three other sidewalls that collectively establish a cavity within which the modules are at least partially received; and the insulation material occupies space within the cavity that is not occupied by the modules.

10. The elevator door coupler of claim 7, wherein the magnetic coupler device comprises a vane body;

the mounting portion of each core is at least partially outside of the housing, each mounting portion is configured to be mounted to the vane body.

11. The elevator door coupler of claim 1, comprising a vane body upon which the modules are mounted; and a fixing tape along one side of the vane body and across ends of the cores.

12. The elevator door coupler of claim 1, comprising a resilient layer along at least a portion of a side of the magnetic coupler device that is adapted to contact the vane member.

13. The elevator door coupler of claim 1, comprising a plurality of housings, each housing at least partially receiving one of the modules, the insulation material occupying space between sidewalls of the housing and the received portions of the corresponding module.

14. The elevator door coupler of claim 1, comprising a housing that receives at least a portion of each of the plurality of modules, the housing having at least one opening along one side of the housing and wherein the insulation material occupies space within the housing between the modules.

15. The elevator door coupler of claim 1, wherein the cores each have a generally U-shaped configuration with two leg portions and a mounting portion that connects the leg portions, a length of the leg portions in a direction extending away from the mounting portion is three times a width of the mounting portion taken in the same direction, a width of the leg portions is equal to a spacing between the legs taken in a direction transverse to the length.

16. An elevator door assembly, comprising:

at least one hoistway door;

at least one elevator car door;

a vane member supported for movement with the hoistway door;

a magnetic coupler device supported for movement with the elevator car door to be selectively magnetically coupled with the vane member, the magnetic coupler device including a plurality of modules each having a core and at least one coil associated with the core and an insulation material occupying a space between the modules for substantially insulating adjacent coils from each other and for maintaining a desired alignment of the modules relative to each other; and at least one housing within which the plurality of modules are at least partially received.

17. The assembly of claim 16, comprising a door hanger associated with the elevator car door;

a door mover comprising a moving member that moves for moving the elevator car door; and a connecting member on the magnetic coupler device that connects to the moving member such that the magnetic coupler device moves with the moving member.

18. The assembly of claim 16, wherein the magnetic coupler device comprises a housing at least partially receiving the modules, and the insulation material occupies space within the housing between the modules and between the modules and sidewalls of the housing.

19. The assembly of claim 18, wherein the housing includes an opening on at least one side of the housing, and the insulation material substantially covers a surface of each module facing the opening.

20. The assembly of claim 16, wherein each module is electromagnetic including a core having two legs and the coil is at least partially wound about each leg.

* * * * *